US005632173A

United States Patent [19]

Spiegelberg et al.

[11] Patent Number: 5,632,173

[45] Date of Patent: May 27, 1997

[54] APPARATUS AND METHOD FOR COLD FORMING A RING ON A LEAD ALLOY BATTERY TERMINAL

[75] Inventors: Bernard N. Spiegelberg, Germantown; Dennis J. Brown, Whitefish Bay, both of Wis.

[73] Assignee: Tulip Corporation, Milwaukee, Wis.

[21] Appl. No.: 443,905

[22] Filed: May 17, 1995

[51] Int. Cl.[6] ..... B21K 21/16

[52] U.S. Cl. ..... 72/68; 72/126

[58] Field of Search ..... 72/68, 104, 107, 72/115, 121, 126

[56] References Cited

U.S. PATENT DOCUMENTS

| | | | |
|---|---|---|---|
| 1,338,462 | 4/1920 | Rydbeck . | |
| 1,668,996 | 5/1928 | Anderson . | |
| 1,766,098 | 6/1930 | Booth . | |
| 1,784,745 | 12/1930 | Nier | 72/68 |
| 1,994,178 | 3/1935 | Raiche . | |
| 2,372,011 | 3/1945 | Remington . | |
| 2,392,175 | 1/1946 | Norton . | |
| 2,526,489 | 10/1950 | Liddicoat . | |
| 2,566,243 | 8/1951 | Nyquist . | |
| 2,966,987 | 1/1961 | Kaul . | |
| 2,978,932 | 4/1961 | Frueauff . | |
| 3,280,613 | 10/1966 | Schröm . | |
| 3,712,099 | 1/1973 | Elsbett et al. | 72/107 |
| 4,177,665 | 12/1979 | Schurmann . | |
| 4,193,179 | 3/1980 | Confer et al. | 72/107 |
| 4,197,772 | 4/1980 | Anderson et al. . | |
| 4,416,141 | 11/1983 | Nippert . | |
| 4,423,617 | 1/1984 | Nippert . | |
| 4,649,731 | 3/1987 | Eisenmann . | |
| 4,653,305 | 3/1987 | Kanamaru et al. . | |
| 4,776,197 | 10/1988 | Scott . | |
| 4,785,649 | 11/1988 | Watanabe et al. . | |
| 4,945,749 | 8/1990 | Walker et al. . | |
| 5,048,590 | 9/1991 | Carter . | |
| 5,296,317 | 3/1994 | Ratte et al. . | |
| 5,349,840 | 9/1994 | Ratte et al. . | |

FOREIGN PATENT DOCUMENTS

| | | |
|---|---|---|
| 0117213 | 8/1984 | European Pat. Off. . |
| 5-169183 | 7/1993 | Japan . |
| 902969 | 2/1982 | U.S.S.R. . |

OTHER PUBLICATIONS

FETTE May 1994 Catalog pp. 123–125, 130–134.

*Primary Examiner*—Lowell A. Larson
*Attorney, Agent, or Firm*—Foley & Lardner

[57] ABSTRACT

A method and apparatus utilizing a ring forming head to cold form a ring on a lead battery terminal. The apparatus includes a fixture, a rolling head having a plurality of rollers, and a drive system for engaging and rotating the rolling head and lead battery terminal relative to each other.

20 Claims, 8 Drawing Sheets

APPARATUS AND METHOD FOR COLD FORMING A RING ON A LEAD ALLOY BATTERY TERMINAL

BACKGROUND OF THE INVENTION

This invention relates generally to an apparatus and method for automated cold forming of a ring on a lead battery terminal.

In general, battery terminals are utilized as an interface between a sealed battery container and an external device seeking electrical power. Battery terminals are typically formed from lead in a cold or hot forming process. In a hot forming process, a lead alloy is heated until it is in a molten state. The molten lead is then poured into a mold or casting and formed into a semi-finished or finished battery terminal. In the cold forming process a lead slug typically at room temperature is subjected to a number of pressing, punching and machining operations in order to create a finished battery terminal.

The hot forming process requires that the lead be heated until it reaches the molten state and then subsequently poured into a mold until it cools. A disadvantage of this method is that it requires the melting of a lead alloy to form the battery terminal. The use of melting for forming terminals may create undesirable porosity and is expensive to implement in an environmentally safe manner.

Existing methods of cold forming a battery terminal from a lead slug require a number of individual steps. In one method a lead slug is first modified in a preform station and then subsequently formed into a finished battery terminal in a final forming press having a split die. Alternatively, in a second method a lead slug is formed into a semi-finished battery terminal in a first station having a split die and then subsequently machined to create a finished battery terminal.

These methods of cold forming a battery terminal require a split die to form the plurality of parallel rings used to prevent movement of the battery terminal along its longitudinal axis. Additionally the split die is used to form the recesses and tabs of the anti-torque ring used to prevent rotation of the terminal about its longitudinal axis.

The method of using a split die to form these rings results in a flash line located on the battery terminal caused by the dividing lines between the portions of the split die. This flash line can result in seepage when the battery terminal is installed in a battery.

Additionally, the recesses and tabs of the anti-torque ring must be angled to permit the removal of the battery terminal from the split die, this results in less than optimal anti-torque properties.

Consequently, it would be desirable to have a battery terminal cold formed from a lead slug that would improve the properties of the anti-torque ring. It would be further desirable to have a battery terminal cold formed from a lead slug without a flash line. It would also be desirable to cold form a battery terminal utilizing a single press.

SUMMARY OF THE INVENTION

The present invention features a method and apparatus for forming rings on a lead battery terminal. An embodiment of the apparatus for forming a lead battery terminal having a ring includes a fixture configured to hold the lead battery terminal. The apparatus further includes a ring forming head configured to form rings on the lead battery terminal when the terminal and ring forming head are rotated relative to each other. A drive assembly fastened to the fixture and head rotate the terminal and ring forming head relative to each other.

An embodiment of the method for forming rings on a lead battery terminal includes engaging a rolling head with the lead battery terminal while the rolling head and the lead battery terminal are rotating relative to each other.

Another embodiment of the apparatus for forming rings on a lead battery terminal includes a station configured to form a cylindrical lead slug having a lead slug pickup station; a transfer mechanism; and a progressive die. The progressive die is provided with four stations: a preform station, a partial-finish station, a near-finish station, and a radial rolling station.

Another embodiment of the method for forming a finished rolled battery terminal having a ring includes forming an elongated cylindrical lead slug from an extruder lead wire. Then stamping the lead slug in a first forming station forming a partial-finished battery terminal including a head having a substantially uniform outer diameter, a splined ring having a plurality of recesses, and a frustum having a tapered recess and a blank end. The partial-finished battery terminal is then transferred to a second through punch station where a near-finished battery terminal having a through hole is formed. The near-finished battery terminal is then transferred to a third rolling station where a rolled battery terminal is formed having a head including an annular ring.

DETAILED DESCRIPTION OF THE PREFERRED EMBODIMENT

Figure 1:
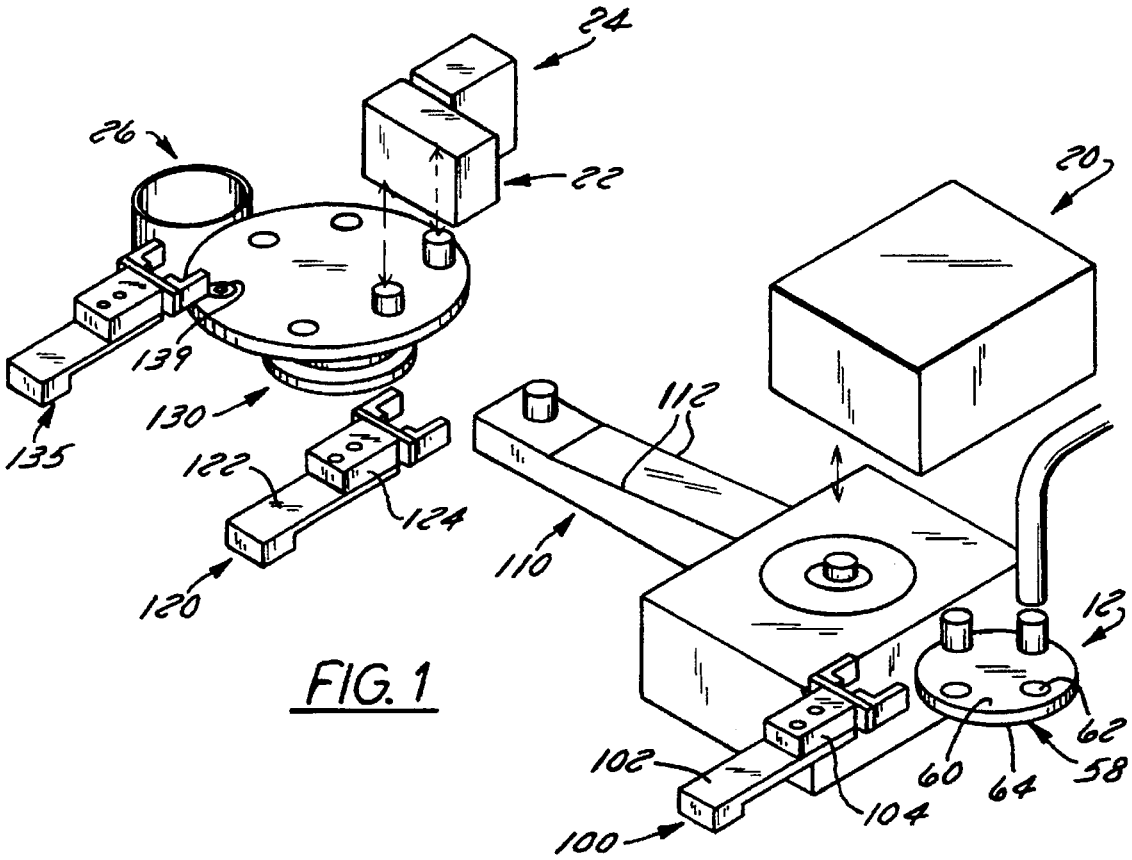
FIG. 1 is a schematic illustration of the lead slug pickup station, forming station, through punch station, radial rolling station, drop station and transfer mechanisms of the preferred embodiment.

Referring to FIG. 1, a battery terminal forming apparatus 10 includes four stations: a lead slug station 12; a forming station 20; a through punch station 22; and a radial rolling station 24. Additionally, apparatus 10 includes a drop station 26, a first pick and place transfer mechanism 100, a vibratory transfer mechanism 110, a second pick and place transfer mechanism 120, an index assembly 130, and a third pick and place transfer mechanism 135.

Apparatus 10 creates a finished rolled battery terminal 30*d* from a lead slug 30*a*. Lead slug 30*a* including a proximal end 32 and a distal end 34 is first transferred from lead slug station 12 to forming station 20 with first pick and place transfer mechanism 100. In forming station 20 lead slug 30*a* is formed into a partial-finished battery terminal 30*b* including a frustum 50 having a frusto-conical shape, a splined ring 48 having a plurality of splined ring recesses 86 and tabs 87, a head 44 having a uniform diameter, and a tapered recess 52 having a blank wall 54.

Partial-finished battery terminal 30*b* is expelled from forming station 20 and positioned by vibratory transfer mechanism 110 for subsequent transfer by second pick and place transfer mechanism 120 to an index assembly 130 for presentation to through punch station 22.

In through punch station 22 partial-finished battery terminal 30*b* is formed into near-finished battery terminal 30*c* having a continuous tapered recess 84. Index assembly 130 is rotatably indexed by an index drive assembly 131 such that near-finished battery terminal 30*c* is positioned in radial rolling station 24. Finally, a finished rolled battery terminal 30*d* having annular rings 46 is formed in radial rolling station 24.

Referring to FIGS. 1–5, the battery terminal forming apparatus 10 will now be described in greater detail. Lead slug 30*a* is formed and presented in lead slug station 12. Lead slug station 12 includes a transfer mechanism (e.g. guide tube) to transfer lead slug 30*a* to an indexing turntable 58. Indexing turntable 58 includes a circular index plate 60 having a plurality of truncated openings 62. Openings 62 are truncated by a base 64.

First pick and place transfer mechanism 100 includes an arm 102 and a gripper 104. Lead slug 30*a* is transferred from lead slug station 12 to forming station 20 by activation of arm 102 and gripper 104.

Figure 2:
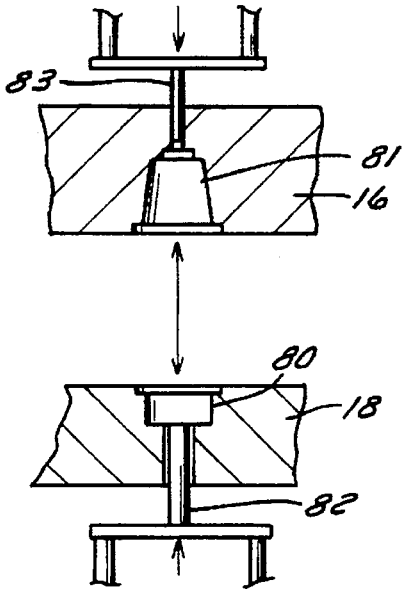
FIG. 2 is a cross-sectional view of the forming station.
Figure 3:
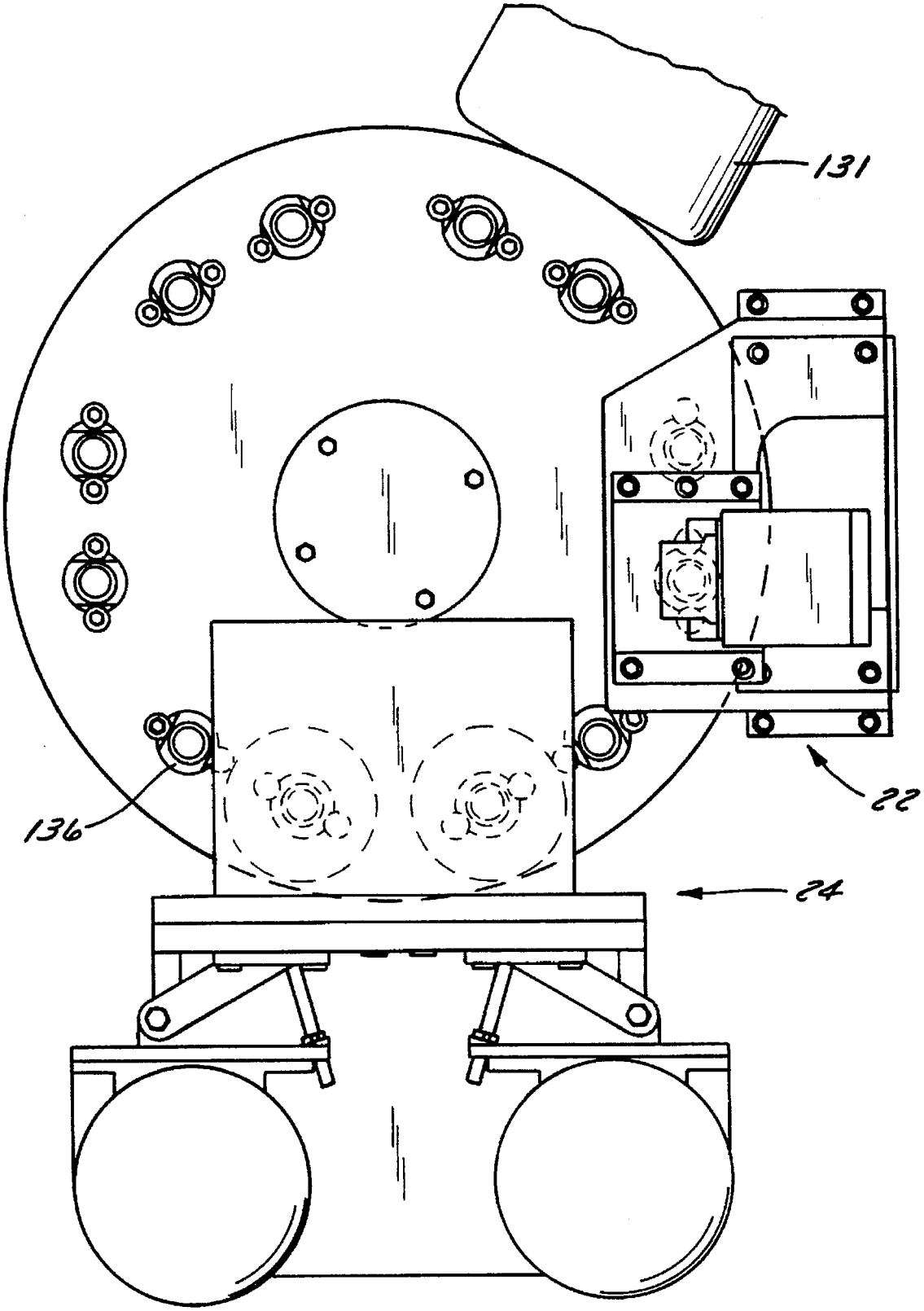
FIG. 3 is a planar view of the indexing turntable.

As shown in FIG. 2, forming station 20 is a stand alone press including a lower die assembly 18 and an upper die assembly 16. Lower die assembly 18 includes a unitary die 80 and forming punch 82. The lower portion of unitary die 80 includes an inner profile configured to form head 44 having a substantially uniform diameter. The upper portion of unitary die 80 includes an inner profile configured to form a plurality of splined ring recesses 86 and tabs 87 of the partial-finished battery terminal 30*b* (FIG. 6*e*). In the preferred embodiment splined ring tabs 87 are defined by a first wall 87*a* and a second wall 87*b* which are substantially parallel to one another. In contrast, where an apparatus uses a split die to form a battery terminal the walls of some splined ring tabs must be angled to permit the opening of the split die (FIG. 6*f*). Upper die assembly 16 includes a forming cavity 81 in alignment with forming punch 82. Forming cavity 81 includes an upper tapered region and a lower portion which respectively forms frustum 50, and an upper region of splined ring 48 of partial-finished battery terminal 30*b*. Upper die assembly 16 further includes a release punch 83 having a release punch end. Forming cavity further includes a cylindrical portion located above the upper tapered region which forms a chimney 40 on partial-finished battery terminal 30*b*.

Referring to FIG. 1 vibratory transfer mechanism 110 includes side walls 112 which are spaced apart a distance less than the diameter of splined ring 48. Side walls 112 are angled downward and are vibrated to translate partial-finished battery terminal 30*b* toward the end of side walls 112.

Referring to FIG. 1 second transfer pick and place mechanism 120 includes an arm 122 and a gripper 124 for transferring a partial-finished battery terminal 30*b* from vibratory transfer mechanism 110 to a fixture or an index assembly 130.

Figure 4:
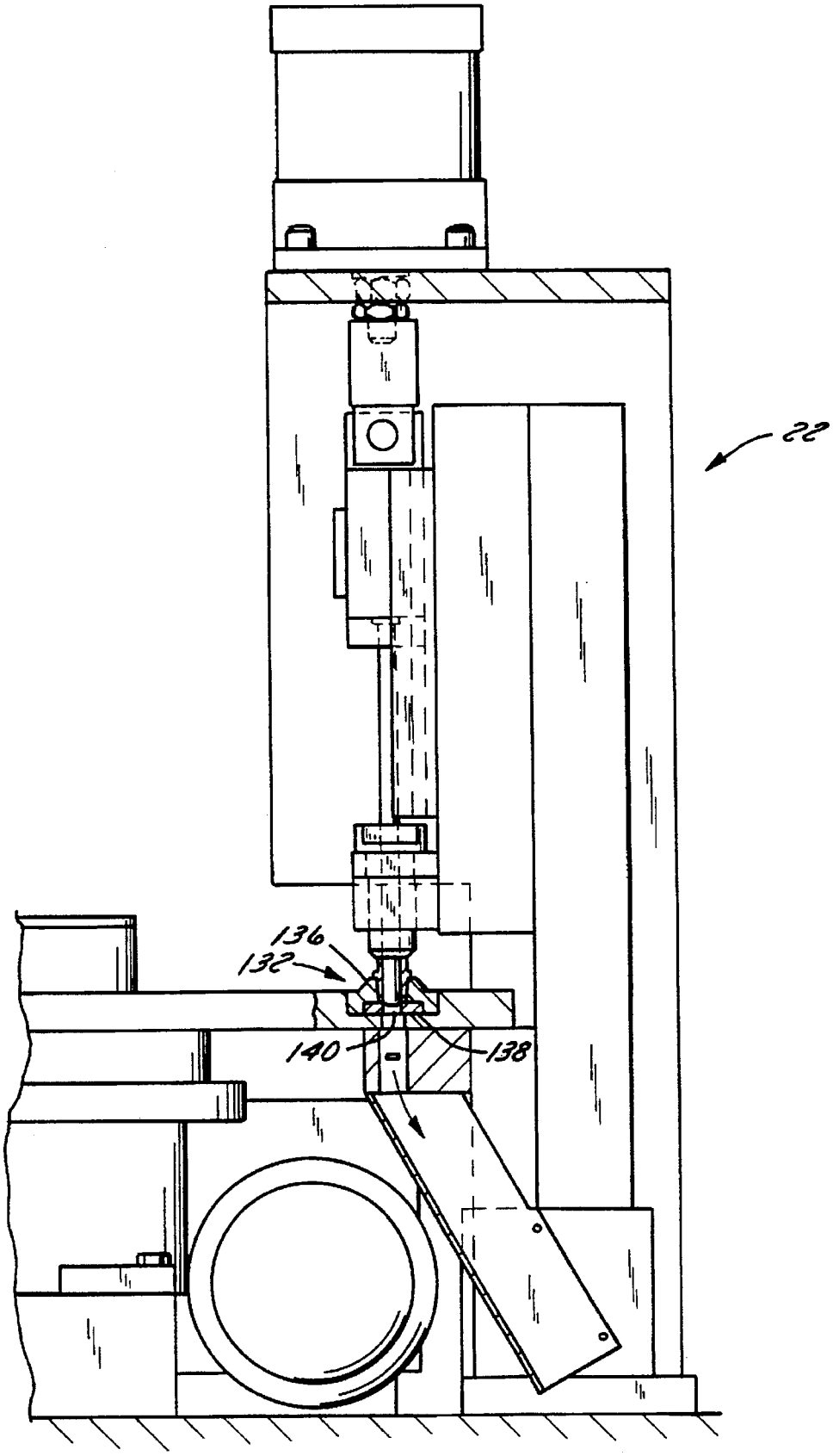
FIG. 4 is a cross-sectional view of the through punch station.

As shown in FIG. 1 and 3–5 index assembly 130 includes a circular index plate 132 mounted for rotary motion on a base 134. Circular index plate 132 includes a plurality of index dies 136, which are configured to support frustum 50 of partial-finished battery terminal 30*b*. As shown in FIG. 4 circular index plate 132 further includes an anvil 138 having an opening 140 located at the base of each index die 136. Anvil 138 is configured to support proximal end 32 of partial-finished battery terminal 30*b*.

Through punch station 22 is mounted in overhanging relationship to the edge of circular index plate 132. Through punch station 22 includes a through punch 92 aligned with the opening 140 of anvil 138.

Figure 5:
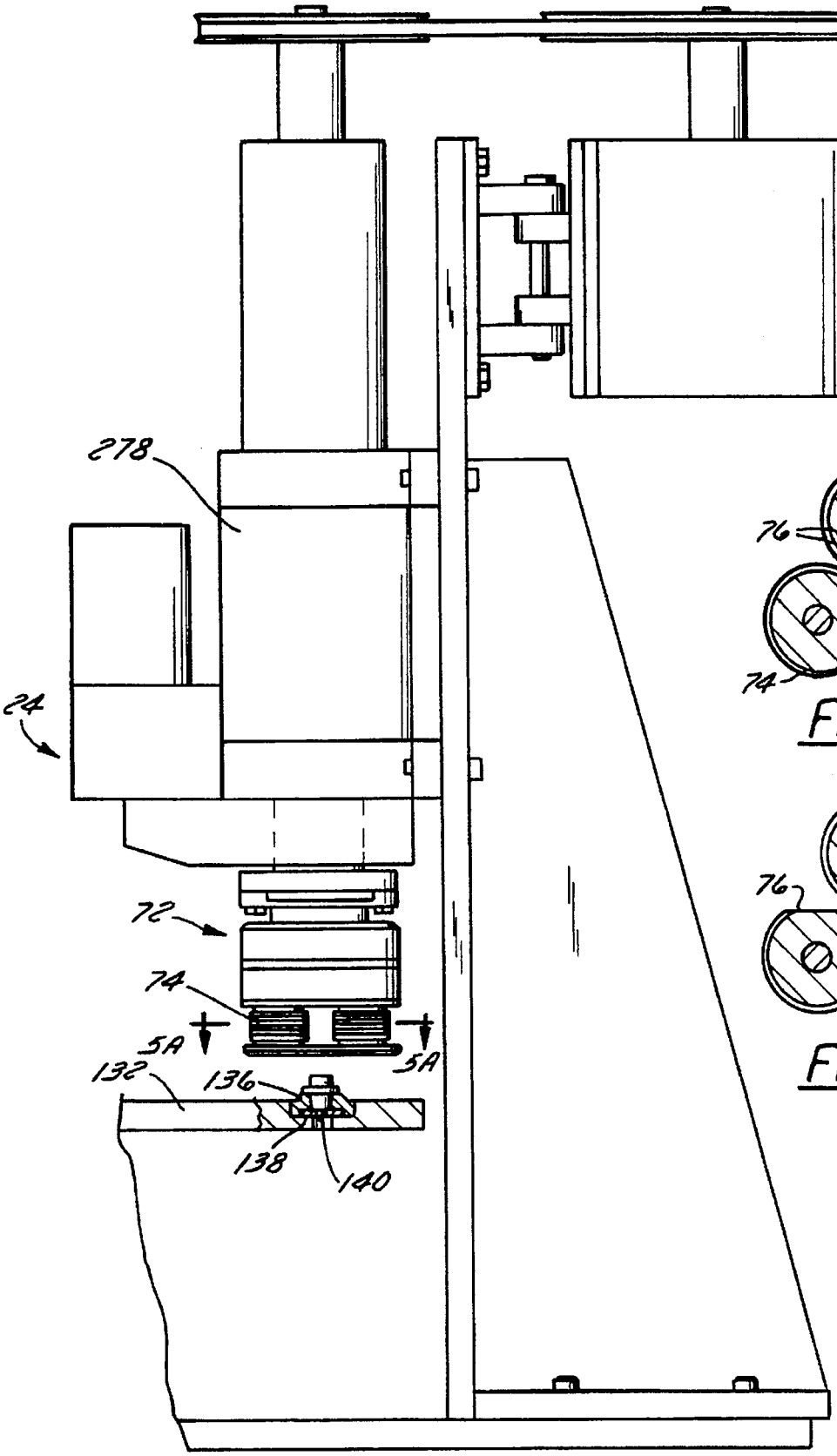
FIG. 5 is a cross-sectional view of the radial rolling head station.
Figure 5A:
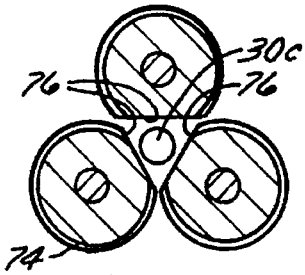
FIG. 5A is a cross-sectional view 5A—5A of the rollers of the radial rolling head station.
Figure 5B:
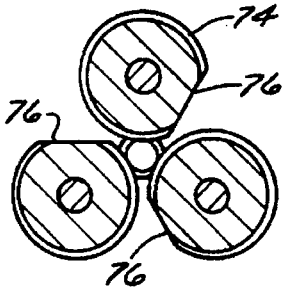
FIG. 5B is a cross-sectional view of the rollers of the radial rolling head station in the engaged position.

As shown in FIG. 5 radial rolling station 24 includes a drive assembly 78, a ring forming head 72 having three rollers 74 configured to form annular rings 46 on near-finished battery terminal 30*c*. Each roller 74 includes a flat portion 76 (FIG. 5*b*). Ring forming head 72 is mounted in overhanging relationship to the edge of circular index plate 132 located in a region other than through punch station 22. Ring forming head 72 is further situated in alignment with index die 136 permitting engagement of ring forming head 72 with head 44 of near-finished battery terminal 30*c*. In this embodiment ring forming head 72 is of the type manufactured by Fette type Radial Rolling Head E 16 A 00 having three rollers 74 configured to create annular rings 46. Index assembly 130 further includes an ejection punch 139 to raise a finished rolled battery terminal from index die 136 (see FIG. 1).

The method of creating a finished battery terminal utilizing apparatus 10 as described in above will now be described in greater detail. An elongated cylindrical lead slug 30*a* is first formed (e.g. cut or sheared) from an extruded lead wire 98 in lead slug station 12. Lead slug 30*a* includes proximal end 32, and distal end 34 (FIG. 3*a*). Lead slug 30*a* is transferred from lead slug station 12 by means of a transfer mechanism (e.g. guide tube) to indexing turntable 58. Lead slug 30*a* is received in opening 62 where proximal end 32 is supported by base 64. Indexing turntable 58 is rotatably indexed to permit lead slugs 30*a* to be removed by first pick and place transfer station 100.

Arm 102 and gripper 104 of first pick and place transfer station 100 transfers lead slug 30*a* from indexing turntable 58 to forming station 20 and places lead slug proximal end 32 in contact with lower die assembly 18 directly below forming cavity 81. When forming station 20 is cycled, upper die assembly 16 and lower die assembly 18 come together. Forming punch 82 is subsequently activated extending from lower die assembly 18 into upper die assembly 16 within forming cavity 81.

Figure 6A:
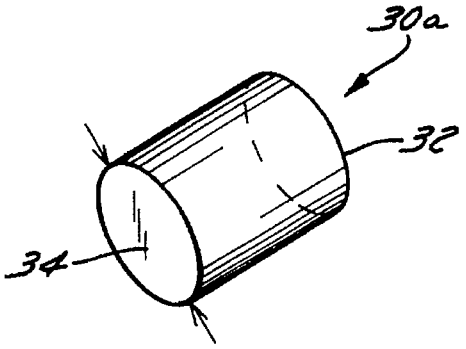
FIG. 6*a* is an isometric illustration of a lead slug.
Figure 6B:
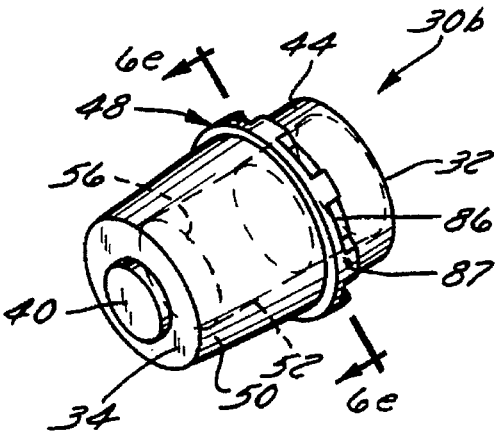
FIG. 6*b* is an isometric illustration of a partial-finished battery terminal.

In this manner partial-finished battery terminal 30*b* is formed including frustum 50, splined ring 48 having splined ring recesses 86 and tabs 87, and head 44 having a substantially uniform diameter (FIG. 6*b*). Additionally, the partial-finished battery terminal 30*b* includes a tapered recess 52 extending from proximal end 32 toward distal end 34 and concluding at a blank wall 54. Frustum 50 further includes a chimney 40 which causes partial-finished battery terminal 30*b* to remain in the upper die assembly 16 as the upper die assembly 16 and lower die assembly 18 separate. Partial-finished battery terminal 30*b* is subsequently expelled by activation of release punch 83. As partial-finished battery terminal 30*b* is released from upper die assembly 16, it is expelled out of forming station 20 by means of a timed blast of compressed air.

Partial-finished battery terminal 30*b* is deposited in vibratory transfer mechanism 110 where the partial-finished battery terminal 30*b* is orientated between side walls 112 such that head 44 is facing up and presented for transfer by second transfer mechanism 120. Arm 122 and gripper 124 of second transfer station transfers partial-finished battery terminal 30*b* from vibratory transfer mechanism 110 to index die 136 such that head 44 is face up and frustum 50 is supported by index die 136 and anvil 138.

Figure 6C:
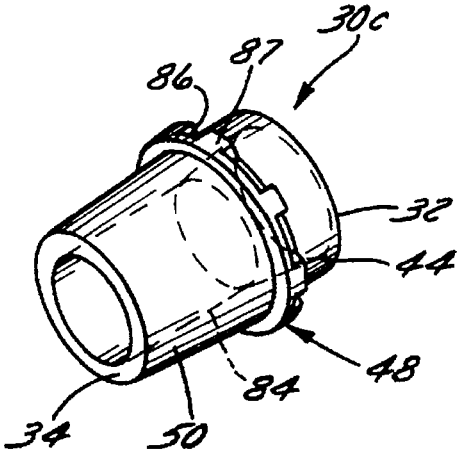
FIG. 6*c* is an isometric illustration of a near-finished battery terminal.

Circular index plate 132 is indexed such that partial-finished battery terminal 30*b* is aligned with through punch station 22. When through punch station 22 is activated through punch 92 removes chimney 40 and a disc 56 from blank wall 54 forming a continuous tapered recess 84 extending from proximal end 32 to distal end 34. In this manner a near-finished battery terminal 30*c* is formed. (FIG. 6*c*).

Figure 6D:
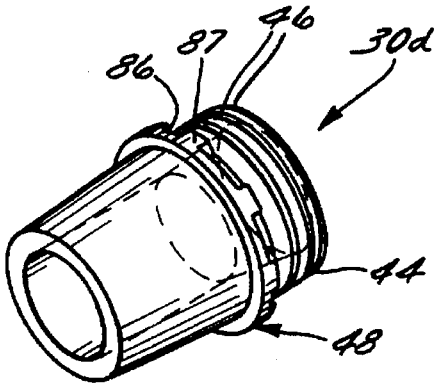
FIG. 6*d* is an isometric illustration of a rolled battery terminal.
Figure 6E:
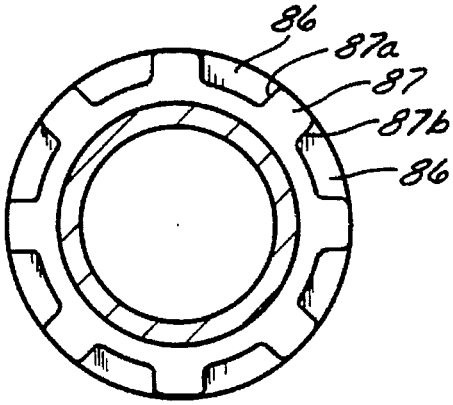
FIG. 6*e* is a cross-sectional view of the splined ring of the rolled battery terminal.
Figure 6F:
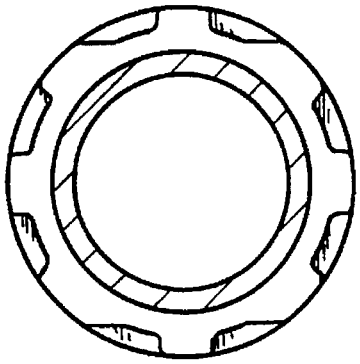
FIG. 6*f* is a cross-sectional view of a splined ring of a prior art battery terminal.

Circular index plate 132 is subsequently indexed such that near-finished battery terminal 30*c* is aligned with radial rolling head station 24. When radial rolling head station 24 is activated ring forming head 72 engages head 44. Rollers 74 are initially positioned such that flat portion 76 of rollers 74 are facing head 44 (See FIG. 5A). Ring forming head 72 is rotated by drive assembly 78 such that rollers 74 are rotated once thereby engaging head 44 and cold forming annular rings 46 (See FIG. 5B). The diameter of head 44 of the near-finished battery terminal 30*c* is modified as a result of the engagement and rotation of the ring forming head 72. Annular rings 46 are formed not by removing material from head 44 but rather by the flowing of material. At the completion of the rotation the flat portions 76 of rollers 74 are facing head 44 permitting the disengagement of ring forming head 72 at the end of the cycle. In this manner a finished rolled battery terminal 30*d* is formed having annular rings 46 (FIG. 6*d*). Additionally, in contrast to a battery terminal formed with a split die, the finished rolled battery terminal 30*d* is formed without a flash line along the longitudinal axis of the battery terminal. In the preferred embodiment, apparatus 10 includes two through punch stations 22, and two radial rolling stations 24 located about circular plate 132. Through punch stations 22 and radial rolling stations 24 are activated in such a manner as to increase the manufacturing rate of apparatus 10.

Ejection punch 139 is activated and raises finished rolled battery terminal 30*d* from index die 136. Transfer mechanism 135 subsequently transfers finished rolled battery terminal 30*d* to drop station 26.

Figure 7:
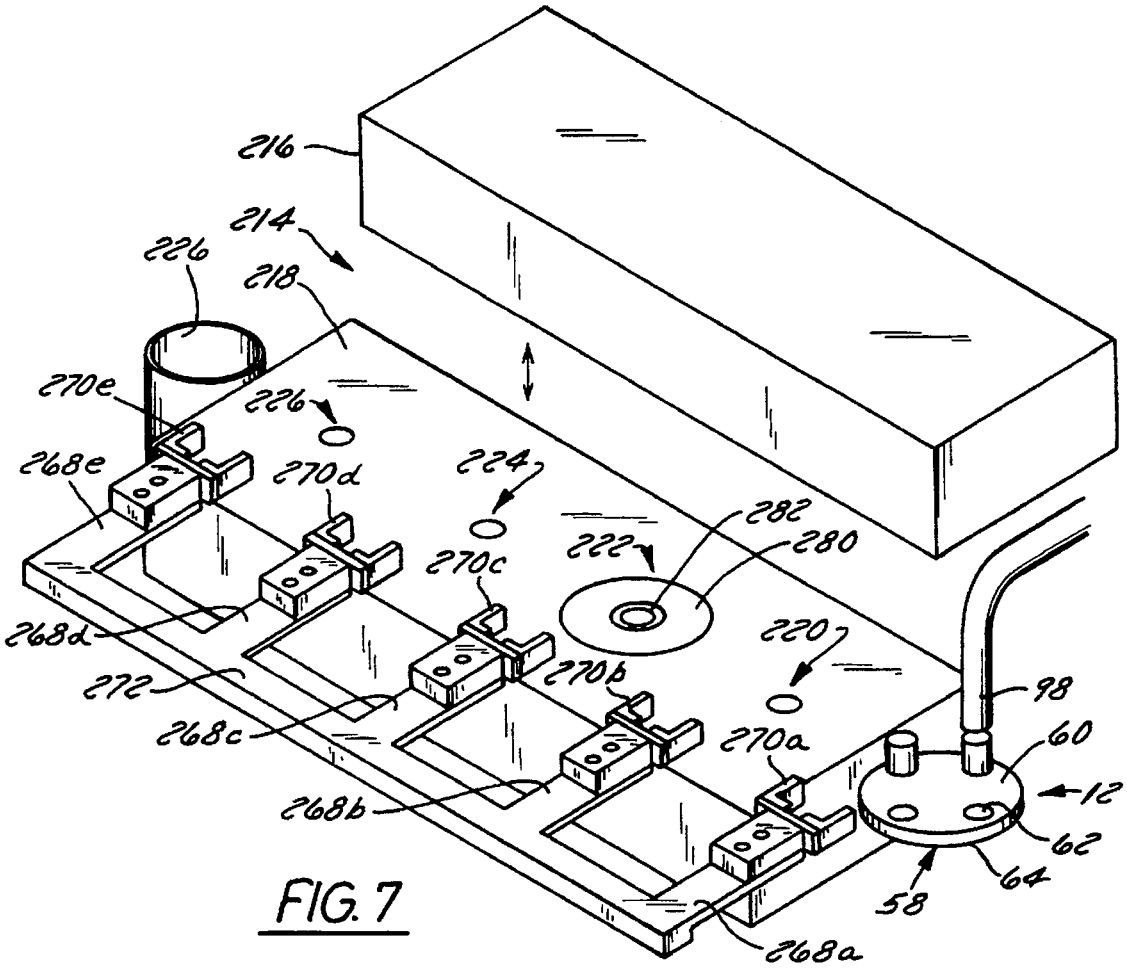
FIG. 7 is a schematic illustration of the lead slug pickup station, progressive die stations, drop station and transfer mechanism of the alternative embodiment.

Referring to FIG. 7, an alternative embodiment of a battery forming apparatus 210 will now be described. Automated battery terminal forming apparatus 210 includes a lead slug station 12, a press structure and system (not shown) provided with a progressive die 214 having an upper die assembly 216 and a lower die assembly 218. Progressive die 214 includes four stations: a preform station 220; a partial-finish station 222; a near-finish station 224; and a rolling station 226. The automated battery terminal forming apparatus 210 further includes a drop station 26 and a five arm transfer mechanism 228.

Apparatus 210 automatically creates a rolled battery terminal 230*e* from a lead slug 230*a*. Transfer mechanism 228 simultaneously indexes lead slugs 230*a* from one station to the next with each cycle of progressive die 214. In preform station 220 lead slug 230*a* is formed into a pre-formed lead slug 230*b* having a lead slug preform cavity 238. Next, in partial-finish station 222 preformed lead slug 230*b* is formed into a partial-finished battery terminal 230*c* including a frustum 250 having a frusto-conical shape, a splined ring 248 having a plurality of recesses 286 and tabs 287, a head 244 having a uniform diameter, and a tapered recess 252 having a blank wall 254.

Subsequently, in near-finish station 224 partial-finished battery terminal 230*c* is formed into a near-finished battery terminal 230*d* having a through hole defined by a continuous tapered recess 252. Finally in rolling station 226 near-finished battery terminal 230*d* is formed into a rolled battery terminal 230*e* having annular rings 246.

Referring to FIGS. 7–10, this alternative embodiment will be described in greater detail. Lead slug station 12 includes a transfer mechanism (e.g. guide tube) to transfer lead slug 230*a* to an indexing turntable 58. Indexing turntable 58 is provided with a circular index plate 60 having a plurality of truncated openings 62. Openings 62 are truncated by a base 64.

Referring to FIG. 7 transfer mechanism 228 is provided with five transfer arms 268*a*, 268*b*, 268*c*, 268*d* and 268*e* which extend normally from a base member 272. Transfer arms 268*a*, 268*b*, 268*c*, 268*d* and 268*e* are respectively provided with grippers 270*a*, 270*b*, 270*c*, 270*d* and 270*e*. Transfer mechanism 228 is cyclically moved with the opening and closing of upper and lower die assemblies 216 and 218 by an appropriate motion controller 229 (e.g. electronically controlled stepping motor, pneumatic or hydraulic drive). In this manner transfer arms 268*a*, 268*b*, 268*c*, 268*d*, and 268*e* are simultaneously activated after each cycle of progressive die 214. Additionally, transfer arm 268*c* and gripper 270*c* include rotational means to rotate partial-finished battery terminal 230*c* 180 degrees.

As shown schematically in FIG. 7, preform station 220 includes a preform station cavity (not shown) located in upper die assembly 216. The preform station cavity includes a preform opening having a diameter which is greater than the outer diameter D10 of lead slug 230*a*. Additionally the preform station cavity terminates at a preform station cavity end. Preform station 220 further includes a preform punch (not shown) located in lower die assembly 218 in alignment with the preform opening in upper die assembly 216. The preform punch has a diameter less than the diameter of the preform opening. When upper die assembly 216 and lower die assembly 218 are activated the preform punch extends beyond the surface of upper die assembly 216 toward the preform station cavity end.

Figure 10A:
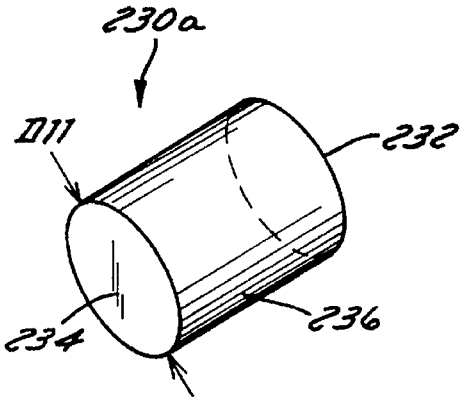
FIG. 10*a* is an isometric illustration of a lead slug.
Figure 10B:
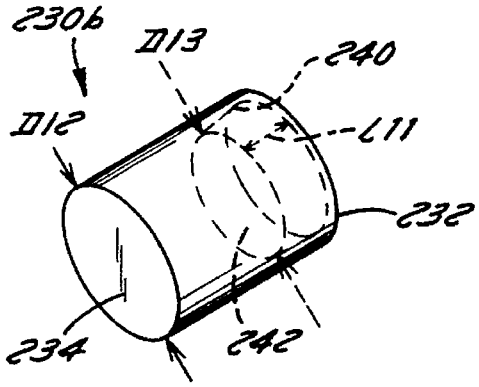
FIG. 10*b* is an isometric illustration of a partial-finished battery terminal.
Figure 10C:
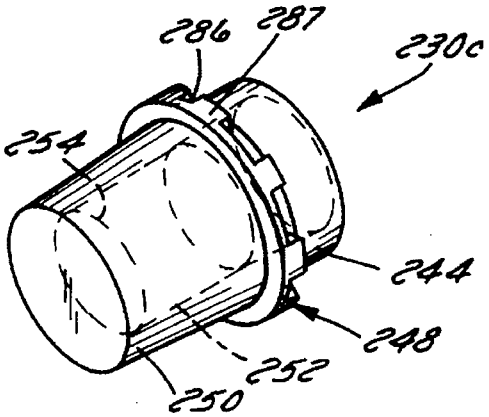
FIG. 10*c* is an isometric illustration of a semi-finished battery terminal.
Figure 10D:
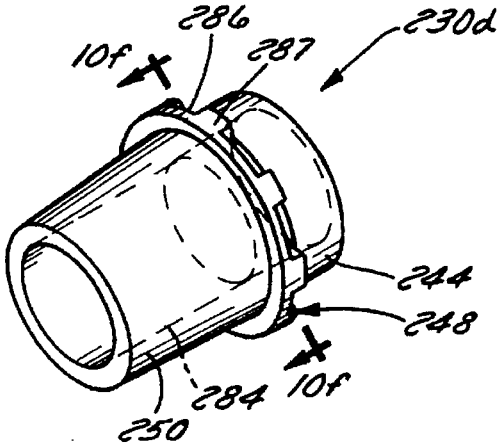
FIG. 10*d* is an isometric illustration of a near-finished battery terminal.
Figure 10E:
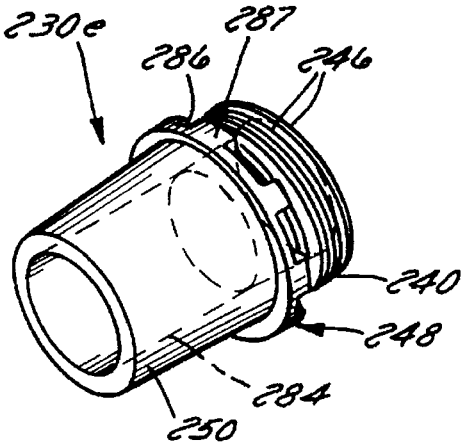
FIG. 10*e* is an isometric illustration of a rolled battery terminal.
Figure 10F:
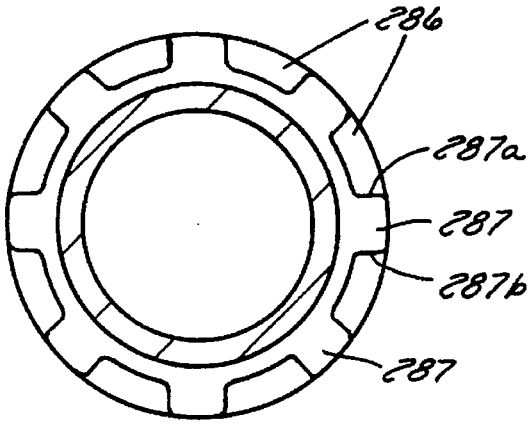
FIG. 10*f* is a cross-sectional view of the splined ring of the rolled battery terminal.

As shown schematically in FIG. 7, the second station in progressive die 214 is partial-finish station 222 which includes a unitary die 280 and forming punch 282 located in lower die assembly 218. In this embodiment unitary die 280 comprises one piece. The lower portion of unitary die 280 is provided with an inner profile configured to form head 244 having a substantially uniform diameter. The upper portion of unitary die 280 has an inner profile configured to form a plurality of splined ring recesses 286 and tabs 287 of the partial-finished battery terminal 230*c* (FIG. 10*f*). Splined ring tabs 287 are defined by a first wall 287*a* and a second wall 287*b* which are substantially parallel to one another. In contrast, where an apparatus uses a split die to form a battery terminal the walls of some splined ring tabs must be angled to permit the opening of the split die (See FIG. 6*f*). Partial-finish station 222 further includes a forming cavity located in upper die assembly 216 in alignment with forming punch 282. The forming cavity in upper die assembly 216 has an upper tapered region configured to form frustum 250 of partial-finished battery terminal 230*c*. The forming cavity further includes a lower portion configured to form an upper region of splined ring 248.

Figure 8:
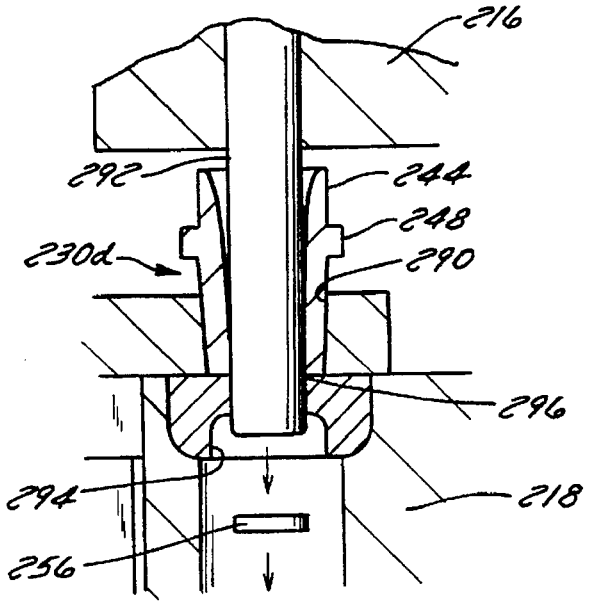
FIG. 8 is a cross-sectional view of the partial-finish station of the alternative embodiment.

Referring to FIG. 8, the third station in progressive die 214 is near-finish station 224 which includes a punching station opening 290 in lower die assembly 218 and a through punch 292 in upper die assembly 216. Lower die assembly 218 further includes an anvil 294 having an anvil aperture 296. Anvil 294 is located in lower die assembly 218 below punching station opening 290.

Figure 9:
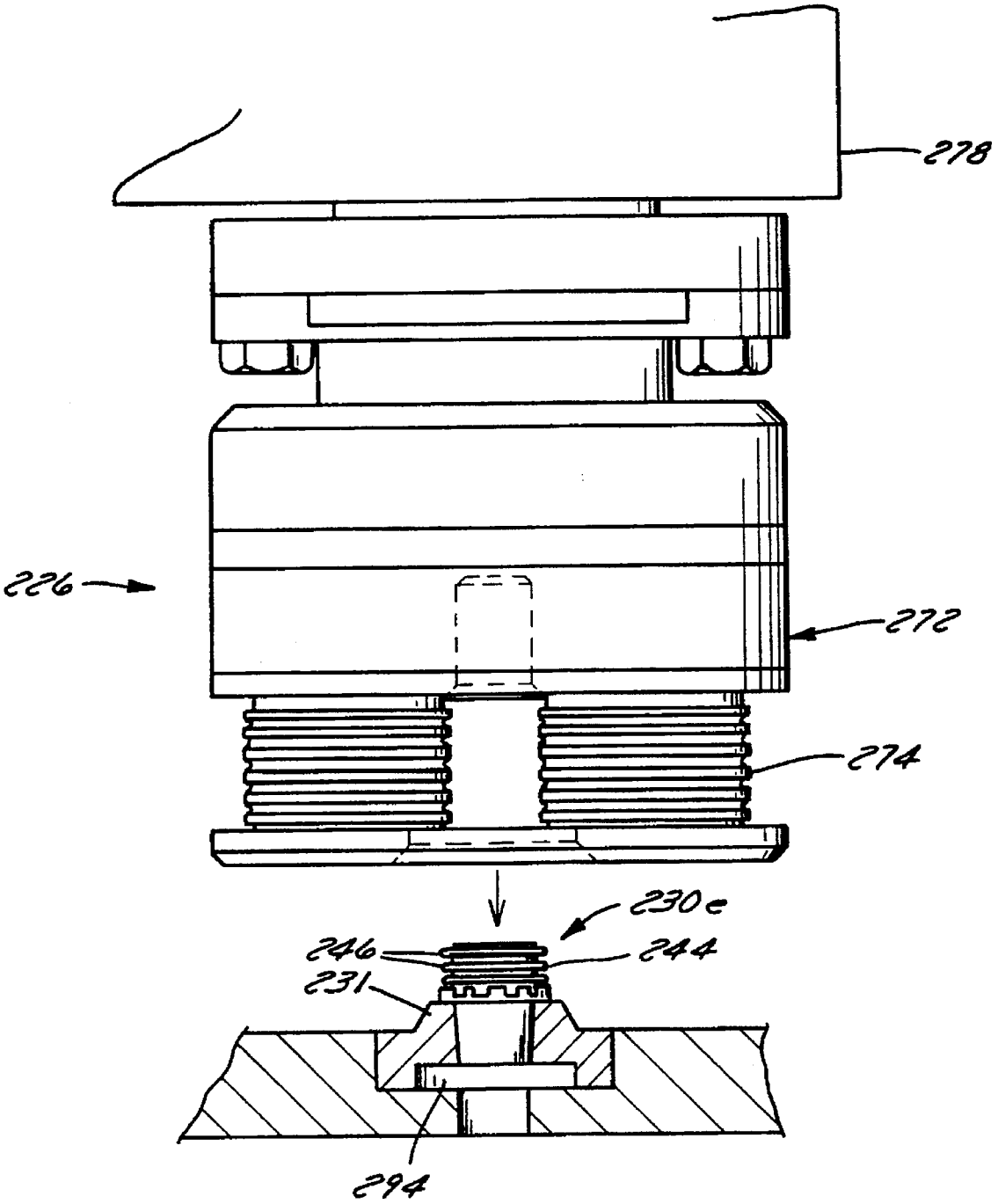
FIG. 9 is a cross-sectional view of the rolling station of the alternative embodiment.

Referring to FIG. 9, the fourth station in progressive die 214 is rolling station 226 which includes a drive assembly 278, a rolling lower die 227 configured to support frustum 250 of near-finished battery terminal 230*d*. Rolling station 226 further includes a ring forming head 272 having three rollers 274. Rollers 274 are configured to create annular rings 246 on head 244 when ring forming head 272 is engaged with near-finished battery terminal 230*d*. In this alternative embodiment ring forming head 272 is of the type manufactured by Fette type Radial Rolling Head E 16 A 00 having three rollers 274 configured to create annular rings 246.

The method of creating a finished battery terminal utilizing apparatus 210 as described above in this alternative embodiment will now be described in greater detail. An elongated cylindrical lead slug 230*a* is first formed (e.g. cut or sheared) from an extruded lead wire 98 in lead slug station 12. Lead slug 230*a* includes a proximal end 232, a distal end 234, an outer diameter D11 and an outer surface 236 (FIG. 10*a*). Lead slug 230*a* is transferred from lead slug station 12 by means of a transfer mechanism (e.g. guide tube) to indexing turntable 58. Lead slug 230*a* is received in opening 62 where proximal end 232 is supported by base 64. Indexing turntable 58 is rotatably indexed to permit lead slugs 230*a* to be removed by transfer mechanism 228.

Transfer mechanism 228 transfers lead slug 230*a* from indexing turntable 58 to preform station 220 with arm 270*a* and gripper 268*a* and places lead slug proximal end 232 in contact with lower die assembly 218 directly below the preform opening. When progressive die 214 is activated the preform punch creates a lead slug preform cavity 238 (FIG. 10*b*) extending from proximal end 232 toward distal end 234. In this manner lead slug 230*a* is formed into preform slug 230*b* including an outer diameter D12, and cavity 238 having a cavity wall 240 and a cavity base 242. Additionally, Cavity 238 is defined by a diameter D13 and a depth L11. Also outer-surface 236 is refined such that diameter D12 of preformed slug 230*b* is the same as the diameter of the preform cavity located in upper die assembly 216.

Transfer mechanism 228 transfers pre-formed lead slug 230*b* from pre-form station 220 to partial-finish station 222 with arm 270*b* and gripper 268*b*. Pre-formed lead slug 230*b* is transferred to partial-finish station 222 such that proximal end 232 having cavity 238 is in contact with lower die assembly 218 and distal end 234 is orientated toward upper die assembly 216.

When progressive die 214 is activated, upper die assembly 216 and lower die assembly 218 come together. Forming punch 282 is subsequently activated extending from lower die assembly 218 into upper die assembly 216 within the upper cavity. In this manner partial-finished battery terminal 230*c* is formed including frustum 250, splined ring 248 having a plurality of splined ring recesses 286 and tabs 287, and head 244 having a substantially uniform diameter (FIG. 10*c*). Additionally, the partial-finished battery terminal 230*c* includes a tapered recess 252 extending from proximal end 232 toward distal end 234 and concluding at a blank wall 254. As the upper die and lower die assemblies 216, 218 separate, partial-finished battery terminal 230*c* remains in the unitary lower die 280 and is subsequently removed by transfer mechanism 228.

Transfer mechanism 228 transfers partial-finished battery terminal 230*c* from partial-finish station 222 to near-finish station 224 with arm 270*c* and gripper 268*c*. Partial-finished battery terminal 230*c* is rotated 180 degrees by gripper 268*c* from partial-finish station 222 to near-finish station 224. In this manner distal end 234 is positioned in lower die assembly 218 and proximal end 232 is orientated toward upper die assembly 216. When progressive die 214 is activated through punch 292 removes a disc 256 from blank wall 254 forming a continuous tapered recess 284 from proximal end 232 to distal end 234. In this manner a near-finished battery terminal 230*d* is formed. (FIG. 10*d*).

Transfer mechanism 228 subsequently transfers near-finished battery terminal 230*d* to rolling station 226 with arm 270*d* and gripper 268*d*. Near-finished battery terminal 230*d* is positioned in a rolling lower die 231, having the form of frustum 250 of partial-finished battery terminal 230*d*. When progressive die 214 is activated ring forming head 272 engages head 244. Rollers 274 are initially positioned such that the flat portion 276 of rollers 274 are facing head 244. Ring forming head 272 is rotated by drive assembly 278 such that rollers 274 are rotated once thereby engaging head 244 and cold forming annular rings 246. At the completion of the rotation the flat roller surface 276 is once again facing head 244 permitting the removal of ring forming head 272 at the end of the cycle. In this manner a finished rolled battery terminal 230*e* is formed having annular rings 246 (FIG. 10*e*). The diameter of head 244 of the near-finished battery terminal 30*c* is modified as a result of the engagement and rotation of the ring forming head 72. Annular rings 46 are formed not by removing material from head 44 but rather by the flowing of material. Additionally, in contrast to a battery terminal formed with a split die, the finished rolled battery terminal 30*d* is formed without a flash line along the longitudinal axis of the battery terminal.

Transfer mechanism 228 subsequently transfers finished battery terminal 230*e* to drop station 26 with arm 268*e* and gripper 270*e*.

As described above with each cycle of the progressive die 214, arm 268*a* and gripper 270*a* transfer lead slug 230*a* from pickup station 12 to pre-form station 220, arm 268*b* and gripper 270*b* transfer pre-formed lead slug 230*b* from pre-form station 220 to partial-finish forming station 222, arm 268*c* and gripper 270*c* transfer partial-finished battery terminal 230*c* from partial-finish station 222 to near-finish station 224, arm 268*d* and gripper 270*d* transfer near-finished battery terminal 230*d* from near-finish station 224 to rolling station 226, and arm 268*e* and gripper 270*e* transfer rolling battery terminal 230*e* from rolling station 226 to drop station 26.

In another embodiment, progressive die 214 includes only three stations, a partial-finish station 222, a near-finish station 224, and a rolling station 226. In this embodiment, lead slug 230*a* is transferred directly to partial-finish station 222.

Although the invention has been described in conjunction with specific embodiments thereof, it is evident that alternatives, modifications and variations will be apparent to those skilled in the art. For example ring forming head may create a single ring 46 or a plurality of rings 46 on the head 44. The ring forming head may also cold form other patterns on head 44 such as a knurled pattern. Additionally, drive assembly 78 may rotate head 44 relative to radial forming head 72. In the alternative embodiment the transfer mechanism 28 may comprise up to five separate devices. The preferred embodiment may include a preform station, and the alternative embodiment may not have a preform station. Additionally, lead slug station 12 may include an in line indexing device in place of a circular index plate 60. It is intended that the claims embrace these and other alternatives, modifications and variations which fall within the spirit and scope of the appended claims.

We claim:

1. An apparatus for forming rings on a lead battery terminal including, a head having an outer surface, and a frustum opposite thereto, the apparatus comprising:

a fixture configured to hold the lead battery terminal;

a ring forming head configured to form rings on the outer surface of the head of the lead battery terminal when the terminal and ring forming head are rotated relative to each other; and a drive assembly fastened to the fixture and head to rotate the terminal and ring forming head relative to each other.

2. The apparatus of claim 1, wherein the fixture includes a plate rotatably supported on a base, the plate having an opening configured to support the lead battery terminal.

3. The apparatus of claim 2, wherein the plate includes a die having a tapered recess to support the battery terminal.

4. The apparatus of claim 2, wherein the rolling head is located above the opening.

5. The apparatus of claim 2, including a transfer mechanism to transfer a battery terminal to the plate.

6. The apparatus of claim 5, including a second drive assembly configured to rotatably index the plate to align the battery terminal with the ring forming head.

7. The apparatus of claim 1, wherein the ring forming head includes a plurality of rollers each having a flat portion, wherein the rollers are configured to form a ring on the lead battery terminal.

8. The apparatus of claim 7, wherein the rollers are configured to form a plurality of parallel rings on the lead battery terminal.

9. A method for forming a ring on a lead battery terminal, the method comprising the steps of:

providing a lead battery terminal including a head having an outer surface; and engaging a ring forming head with the outer surface of the head of the lead battery terminal while the ring forming head and the lead battery terminal are rotating relative to each other to form a radial ring on the outer surface of the head of the lead battery terminal.

10. The method of claim 9, further comprising the step of transferring the lead battery terminal to a rotatable plate configured to support the lead battery terminal.

11. The method of claim 10, further comprising the step of supporting the lead battery terminal in a rolling die located within the plate configured to support a frustum of the lead battery terminal.

12. The method of claim 9, further comprising the step of rotating the fixture to align the lead battery terminal with the ring forming head.

13. The method of claim 9, further comprising the step of engaging a plurality of rolling head rollers with the lead battery terminal forming a ring on the lead battery terminal.

14. The method of claim 13, further comprising the step of rotating the rolling head rollers and lead battery terminal relative to each other forming a ring on the lead battery terminal.

15. A method for manufacturing lead battery terminals in a cold forming process, the method comprising the steps of:

forming an elongated cylindrical lead slug from an extruder lead wire;

stamping the lead slug in a first forming station forming
a partial-finished battery terminal including
a head having an outer surface,
a splined ring having a plurality of recesses and tabs, and
a frustum having a tapered recess and a blank end;

transferring the partial-finished battery terminal to a second through punch station;

punching the partial-finished battery terminal in the second through punch station forming a near-finished battery terminal having a through hole;

transferring the near-finished battery terminal to a third rolling station; and engaging a ring forming head on the outer surface of the head of the near-finished battery terminal in the third rolling station forming a rolled battery terminal having a head including an annular ring.

16. The method of claim 15 wherein the step of stamping the lead slug in a first forming station forming a partial-finished battery terminal including a splined ring having a plurality of recesses and tabs, wherein each tab includes a first and second wall substantially parallel to each other.

17. A method for manufacturing lead battery terminals in an automated process using a progressive die, the method comprising the steps of:

transferring a lead slug with a transfer mechanism to a partial-finish station;

stamping the lead slug in the partial-finish station forming
a partial-finished battery terminal including
a head having an outer surface,
a splined ring having a plurality of recesses and tabs, and
a frustum having a tapered recess and a blank end;

transferring the partial-finished battery terminal to a near-finish station;

punching the partial-finished battery terminal in the near-finish station forming a near-finished battery terminal having a through hole;

transferring the near-finished battery terminal to a rolling station; and engaging a ring forming head on the head of the near-finished battery terminal in the rolling station forming a rolled battery terminal having a head including a ring extending from the outer surface.

18. The method of claim 17, including the step of simultaneously forming the lead slug, partial-finished battery terminal, near-finished battery terminal and rolled battery terminal.

19. The method of claim 17, including the step of simultaneously transferring the lead slug, pre-formed slug, partial-finished battery terminal, near-finished battery terminal, and rolled battery terminal to the next station.

20. The method of claim 19, including the step of rotating the partial-finished battery terminal 180 degrees prior to placement in the near-finish station.

* * * * *